US005179762A

United States Patent [19]

Wisnasky

[11] Patent Number: 5,179,762

[45] Date of Patent: Jan. 19, 1993

[54] VACUUM CLEANER

[75] Inventor: Donald Wisnasky, Eureka, Mo.

[73] Assignee: D & S Manufacturing Co., High Ridge, Mo.

[21] Appl. No.: 729,615

[22] Filed: Jul. 15, 1991

[51] Int. Cl.[5] ..... A47L 5/38

[52] U.S. Cl. ..... 15/314; 15/422.2

[58] Field of Search ..... 15/422.2, 314, 347

[56] References Cited

U.S. PATENT DOCUMENTS

| | | | |
|---|---|---|---|
| 3,974,541 | 8/1976 | Silvis et al. | 15/422.2 |
| 4,087,881 | 5/1978 | Bates | 15/422.2 |
| 4,194,262 | 3/1980 | Finley et al. | 15/310 |
| 4,233,706 | 11/1980 | Kauffeldt | 15/422.2 |

*Primary Examiner*—Chris K. Moore

*Attorney, Agent, or Firm*—Senniger, Powers, Leavitt & Roedel

[57] ABSTRACT

A vacuum cleaner having a housing having a front and a rear and laterally opposite sides, and an opening in each side of the housing permitting communication with the interior of the housing. Each opening is generally located intermediate the front and rear of the housing. A partition located inside the housing divides at least a portion of the volume enclosed by the housing into two chambers of substantially equal volume, which are substantially sealed from one another. Vacuum pumps create a vacuum in the chambers relative to ambient. The partition is constructed and arranged so that the opening is a first of the sides of the housing communicates solely with a first of the chambers, and an opening in a second of the sides communicates solely with a second of the chambers.

9 Claims, 1 Drawing Sheet

VACUUM CLEANER

BACKGROUND OF THE INVENTION

This invention relates generally to vacuum cleaners and more Particularly to a vacuum cleaner having dual vacuum chambers.

Vacuum cleaners typically comprise a single housing or cannister to which is connected a single vacuum hose. This arrangement is satisfactory for many uses of the vacuum cleaner. However, a vacuum cleaner capable of handling only a single hose results in inefficiencies in certain applications such as for coin operated vacuum cleaners of the type at a commercial car wash. Because each vacuum cleaner can service only one vehicle at a time, several separate vacuum cleaners are required to service all of the vehicles requiring vacuuming. Moreover, these vacuum cleaners must be spaced apart a significant distance, because of the size of the vehicles, and a separate concrete island must be poured to support the vacuum cleaner. Frequently, particularly in metropolitan areas, it is economically infeasible to operate a car wash on a relatively large tract of land. In addition, each separate vacuum cleaner purchased represents a significant investment of capital for the car wash owner.

SUMMARY OF THE INVENTION

Among the several objects and features of the present invention may be noted the provision of a vacuum cleaner which can independently and simultaneously service at least two areas to be cleaned; the provision of such a vacuum cleaner which is compact in design; the provision of such a vacuum cleaner which can be easily accessed for removing dirt and debris collected in the vacuum cleaner cannister; the provision of such a vacuum cleaner which draws a powerful vacuum independently to two hoses; and the provision of such a vacuum cleaner which is inexpensive to manufacture and simple to operate.

Generally, a vacuum cleaner constructed according to the principles of the present invention comprises a housing enclosing a volume, the housing having a front and a rear and laterally opposite sides. An opening in each side of the housing permits communication with the interior of the housing, with each opening being generally located intermediate the front and rear of the housing. A partition located inside the housing divides at least a portion of the volume enclosed by the housing into two chambers of substantially equal volume, which are substantially sealed from one another. Vacuum pump means is adapted to create a vacuum in the chambers relative to ambient. The partition is constructed and arranged so that the opening in a first of the sides of the housing communicates solely with a first of the chambers, and an opening in a second of the sides communicates solely with a second of the chambers.

Other objects and features of the present invention will be in part apparent and in part pointed out herein after.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
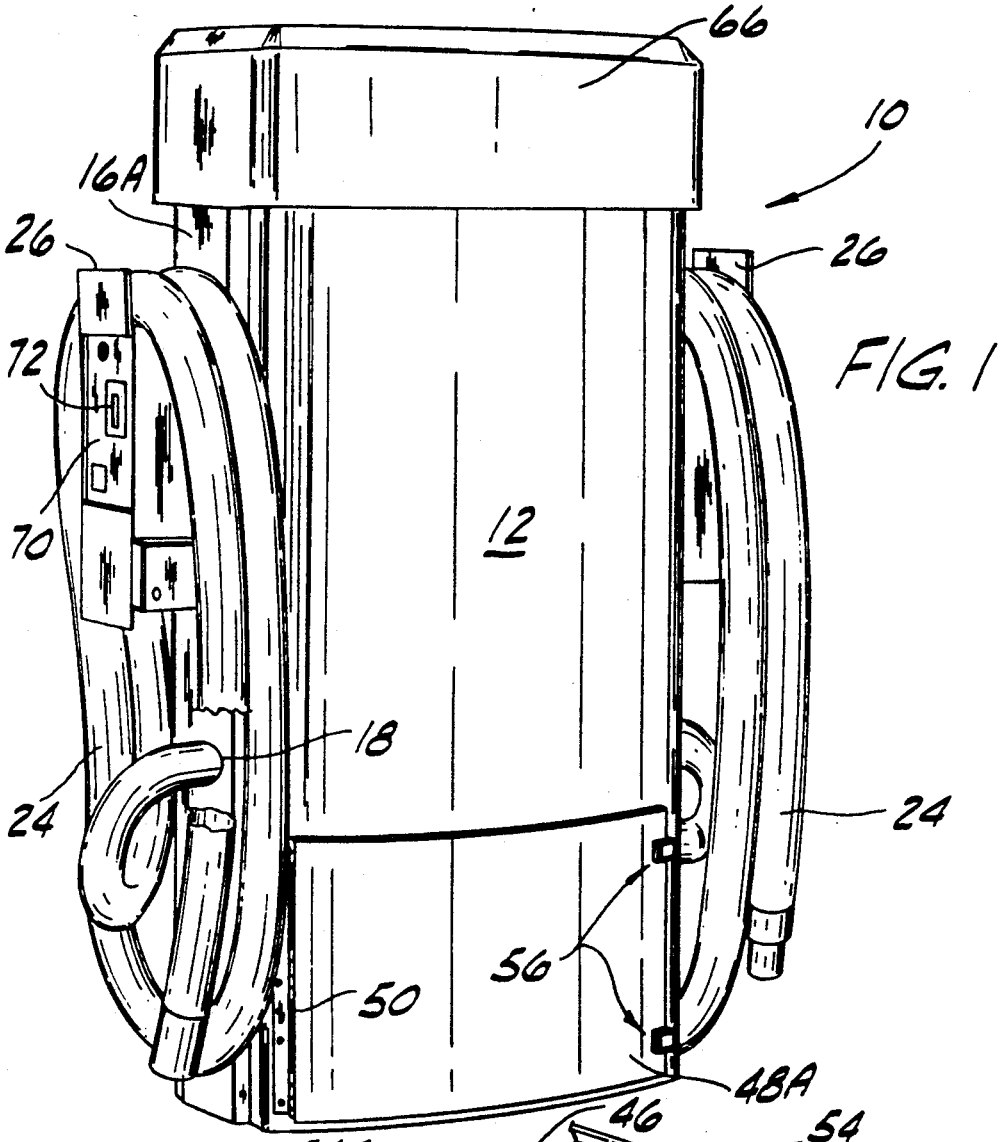
FIG. 1 is a perspective of a vacuum cleaner of the present invention.
Figure 2:
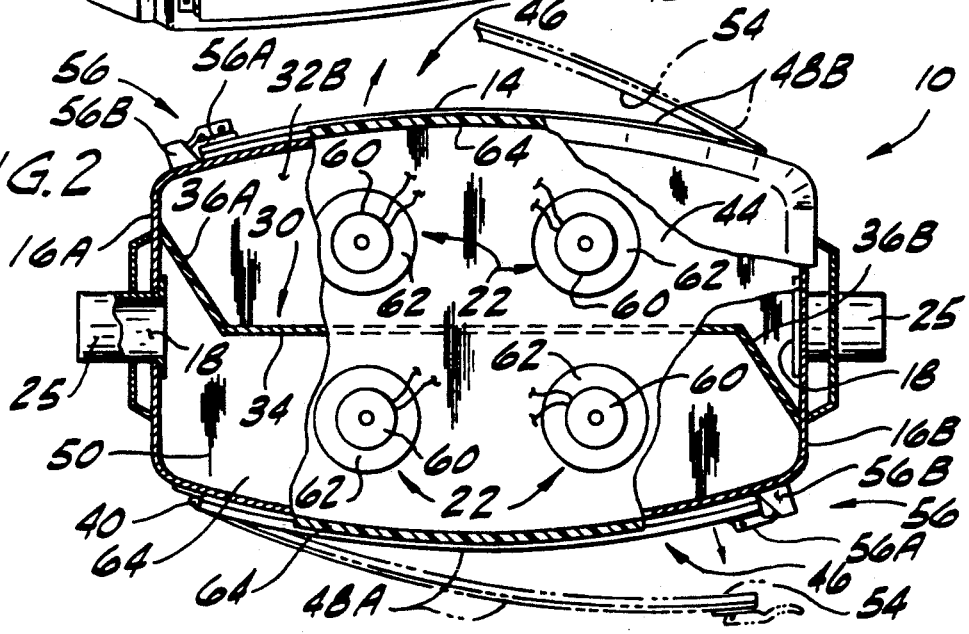
FIG. 2 is a plan view of the vacuum cleaner with parts broken away to show details.

Referring now to the drawings, a vacuum cleaner of the present invention is shown to comprise a housing or cannister, indicated generally at 10, having a front 12, a rear 14 and laterally opposing sides 16A, 16B. In this embodiment, the cannister 10 is formed from sheets of 14 guage stainless steel, but other materials may be used and still fall within the scope of the present invention. An opening 18 in each side of the cannister 10 permits communication with the interior of the cannister in which a partial vacuum may be selectively maintained by the operation of vacuum pumps 22. Elongate, flexible hoses 24 connected to fittings 25 fixed in the openings 18, may be stored, when not in use, in coils around brackets 26 (broadly, "holding means") mounted on the sides 16A, 16B of the cannister 10.

The volume enclosed by the cannister 10 is divided by a partition, generally indicated by the reference numeral 30, into two chambers 32A, 32B of substantially equal volume, which are substantially sealed from one another. The partition 30 is constructed and arranged so that the opening 18 in a first side 16A of the cannister 10 communicates solely with a first of the chambers 32A, and the opening 18 in a second side 16B of the cannister communicates solely with a second of the chambers 32B. The partition 30 comprises a panel including a middle portion 34, and integral first and second laterally opposite end portions, designated 36A and 36B, respectively. The middle portion 34 lies generally in a laterally extending vertical plane generally intermediate the front 12 and rear 14 of the cannister 10. The first end portion 36A extends laterally from a lateral edge of the middle portion 34 and rearwardly out of the plane of the middle portion. The first end portion 36A engages the inside wall of the cannister 10 along a line rearward of the opening 18 in the first side 16A of the cannister. The second end portion 36B extends laterally from the opposite lateral edge of the middle portion 34 and forwardly out of the plane of the middle portion. The second end portion 36B engages the inside wall of the cannister 10 along a line forward of the opening 18 in the second side 16B of the cannister.

Thus, the opening 18 in the first side 16A of the cannister communicates solely with a first of the chambers 32A, and the opening 18 in the second side 16B of the cannister communicates solely with a second of the chambers 32B. The construction of the partition 30 allows the openings 18 to be placed in a symmetrical position midway between the front 12 and rear 14 of the cannister 10, thus giving the vacuum cleaner a pleasing, balanced appearance. The end portions 36A, 36B of the partition 30 are attached to the inside wall of the cannister 10, such as by welding. The partition 30 is also attached, such as by welding, to a lower wall 40 of the cannister 10, and to the mounting plate 44 so that the partition sealingly separates the two chambers 36A, 36B.

The end portions 36A, 36B of the partition are planar and slope out of the plane of the middle portion 34 generally adjacent the openings 18. However, it is to be understood that the end portions 36A, 36B can have other shapes (e.g., such as being curved) and still fall within the scope of the present invention. Good results have been achieved by orienting the partition 30 so that it extends generally between the sides 16A, 16B of the cannister 10, and by locating the end portions 36A, 36B relatively close to the openings 18. The end portions deflect the dirt and debris drawn into the chambers 32A, 32B outwardly against the curved inside wall of the cannister 10. The dirt and debris moves along the curved inside wall of the cannister 10 from the front 12 or rear 14 of the cannister to the sides 16A, 16B, causing the dirt and debris to move in a swirling motion in the chambers. It has been found that where such motion can be achieved, the dirt and debris settles more quickly at the bottom of the chambers 32A, 32B, rather than flying about in the chambers. Larger amounts of flying dirt and debris will cause the vacuum filters (not shown) over the vacuum pumps 22 to clog more quickly than if the dirt and debris settles relatively quickly at the bottom of the chambers 32A, 32B.

Dirt and debris drawn from vehicles being cleaned through the hoses 24 into the chambers 32A, 32B collects at the bottom of the chambers. The dirt and debris can be removed from the chambers through openings 46 in the front 12 and rear 14 of the cannister 10. During operation of the vacuum cleaner, the openings 46 are covered by first and second doors, indicated at 48A and 48B respectively. The doors are pivotally mounted by hinges 50 on the front 12 and rear 14 of the cannister 10 for swinging movement between an open position in which the openings 46 in the front and rear of the cannister are exposed and a closed position in which the doors cover the openings. The peripheries of the doors 48A, 48B are lined with an elastomeric material 54 which engages an edge margin of the cannister 10 surrounding the openings 46 to seal the doors over the openings. Two latch assemblies 56 are mounted on each door 48A, 48B. Each latch assembly includes a member 56A mounted on each of the doors 48A, 48B and a member 56B on the cannister 10. The members 56A, 56B are selectively interengageable to pull the doors 48A, 48B tightly against the cannister 10 to facilitate formation of a seal with the cannister around the opening 46.

The mounting plate 44 has four openings (not shown) in it, two of which communicate with the first 32A of the two chambers and two of which communicate with the second 32B of the chambers. One of the vacuum pumps 22 (each of which comprise an electric motor 60 driving a fan 62) is supported by the mounting plate 44 over each opening in the mounting plate. A gasket (not shown) at the bottom of each of the pumps 22 engages the mounting plate 44 around the openings for sealing the pumps with the mounting plate. The mounting plate 44 covers the open top of the cannister 10 and a seal 64 of elastomeric material at the peripheral edge of the mounting plate engages the upper end of the cannister for sealing with the cannister. A lid 66, which may be made of weather-resistant plastic, fits over the vacuum pumps 22 and the mounting plate 44, and presses down against the vacuum pumps so that the gasket (not shown) seals tightly around the openings in the mounting plate. This same compressive force pushes the seal 64 of the mounting plate 44 tightly against the upper edge of the cannister 10. The lid 66 may be brightly colored for a decorative appearance of the vacuum cleaner.

The electric motors 60 of the vacuum pumps 22 are controlled by coin-operated control units 70 (broadly "control means") mounted on the sides 16A, 16B of the cannister 10 generally under the vacuum hose holding brackets 26. Only one of the control units 70 is shown in the drawings (FIG. 1), the other being identical to it. In the preferred embodiment, the control units 70 are Drop Coin meters manufactured by D&S Manufacturing of High Ridge, Mo. The control units 70 are made with 10 guage stainless steel, and activate the electric motors 60 of the vacuum pumps for a predetermined amount of time upon insertion of a pre-established amount of currency into coin slots 72 in the units. It is to be understood that other control units constructed of other materials may be used and still fall within the scope of the present invention. Each of the units 70 controls two of the vacuum pumps 22 communicating with one of the chambers (32A or 32B) such that the vacuum hoses 24 connected to the respective chambers can be used independently of each other. Thus, two vehicles may be vacuumed in a relatively small area around one vacuum cleaner.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A vacuum cleaner comprising a housing enclosing a volume, the housing having a front and a rear and laterally opposite sides, an opening in each side of the housing permitting communication with the interior of the housing, each opening being generally located intermediate the front and rear of the housing, a partition located inside the housing dividing at least a portion of the volume enclosed by the housing into two chambers of substantially equal volume, the chambers being substantially sealed from one another, vacuum pump means adapted to create a vacuum in the chambers relative to ambient, the partition being constructed and arranged so that the opening in a first of the sides of the housing communicates solely with a first of the chambers, and an opening in a second of the sides communicates solely with a second of the chambers.

2. A vacuum cleaner as set forth in claim 1 wherein the partition comprises a panel including a middle portion and first and second laterally opposite end portions, the middle portion lying generally in a laterally extending vertical plane generally intermediate the front and rear of the housing, said first end portion extending laterally from a lateral edge of the middle portion and rearwardly out of the plane of the middle portion and engaging the housing along a line rearward of the opening in a first of the sides of the housing, and the second end portion extending laterally from a lateral edge of the middle portion and forwardly out of the plane of the middle portion and engaging the housing along a line forward of the opening in a second of the sides of the housing, such that one of the openings in the sides of the housing communicates solely with a first of the chambers and the other of the two openings communicates solely with a second of the chambers.

3. The vacuum cleaner as set forth in claim 1 wherein said vacuum pump means comprises at least two vacuum pumps for each chamber.

4. The vacuum cleaner as set forth in claim 3 wherein the housing comprises a lid portion adapted for connection to the remainder of the housing, and wherein the vacuum cleaner further comprises means mounting the vacuum pumps on the housing generally at the top thereof.

5. The vacuum cleaner as set forth in claim 3 further comprising coin-operated control means for controlling operation of the vacuum pumps on a time basis upon insertion of a predetermined amount of currency in said control means, said control means being adapted to independently operate the vacuum pumps a first of the chambers and the vacuum pumps in a second of the chambers.

6. The vacuum cleaner as set forth in claim 5 wherein said control means comprises two control units, each unit being mounted on a respective side of the housing and controlling the operation of the vacuum pumps in a respective chamber.

7. The vacuum cleaner as set forth in claim 1 further comprising an elongate vacuum hose for each of the openings in the sides of the housing, the vacuum hoses being adapted for connection to the housing at the openings.

8. The vacuum cleaner as set forth in claim 7 further comprising means mounted on the housing for holding the vacuum hoses.

9. The vacuum cleaner as set forth in claim 1 wherein the housing further comprises a first door pivotally mounted on the front of the housing for movement between an open position in which an opening communicating with a first of the chambers in the housing is exposed, and a closed position in which said first door sealingly closes said opening, and a second door pivotally mounted on the rear of the housing for movement between an open position in which an opening communicating with a second of the chambers in the housing is exposed, and a closed position in which the second door sealingly closes said opening.

* * * * *